US008882868B2

(12) United States Patent
Walia et al.

(10) Patent No.: US 8,882,868 B2
(45) Date of Patent: Nov. 11, 2014

(54) ABRASIVE SLICING TOOL FOR ELECTRONICS INDUSTRY

(75) Inventors: Parul Walia, Houston, TX (US); Srinivasan Ramanath, Holden, MA (US); Richard W. Hall, Southborough, MA (US)

(73) Assignees: Saint-Gobain Abrasives, Inc., Worcester, MA (US); Saint-Gobain Abrasifs, Conflans-Sainte-Honorine (FR)

( * ) Notice: Subject to any disclaimer, the term of this patent is extended or adjusted under 35 U.S.C. 154(b) by 223 days.

(21) Appl. No.: 12/494,602

(22) Filed: Jun. 30, 2009

(65) Prior Publication Data

US 2010/0000159 A1 Jan. 7, 2010

Related U.S. Application Data

(60) Provisional application No. 61/077,604, filed on Jul. 2, 2008.

(51) Int. Cl.

| | |
|---|---|
| ***B24B 1/00*** | (2006.01) |
| ***B24D 3/00*** | (2006.01) |
| ***B24D 5/12*** | (2006.01) |
| ***B24D 3/06*** | (2006.01) |

(52) U.S. Cl.

CPC ... *B24D 3/06* (2013.01); *B24D 5/12* (2013.01)
USPC ..... 51/296; 51/297; 51/309

(58) Field of Classification Search

USPC ..... 51/296, 309
See application file for complete search history.

(56) References Cited

U.S. PATENT DOCUMENTS

| | | | | | |
|---|---|---|---|---|---|
| 2,828,197 | A | * | 3/1958 | Blackmer, Jr. | 51/309 |
| 2,831,243 | A | * | 4/1958 | Thomson | 75/233 |
| 2,849,789 | A | * | 9/1958 | Thomson | 75/243 |
| 3,352,647 | A | * | 11/1967 | MacDonald et al. | 428/567 |
| 3,352,668 | A | * | 11/1967 | MacDonald et al. | 419/27 |
| 3,372,010 | A | * | 3/1968 | Parsons | 51/309 |
| 3,886,925 | A | | 6/1975 | Regan | |
| 3,973,925 | A | | 8/1976 | Asaeda et al. | |

(Continued)

FOREIGN PATENT DOCUMENTS

| | | |
|---|---|---|
| JP | 63-297489 | 12/1988 |
| JP | 10-64779 | 3/1989 |

(Continued)

OTHER PUBLICATIONS

International Search Report and Written Opinion, mailed Feb. 17, 2010, from corresponding International Application No. PCT/US2009/049158, filed Jun. 30, 2009.

(Continued)

*Primary Examiner* — Kaj K Olsen
*Assistant Examiner* — Ross J Christie
(74) *Attorney, Agent, or Firm* — Joseph P. Sullivan; Abel Law Group, LLP

(57) ABSTRACT

A bond matrix for metal bonded abrasive tools includes a metal bond system, porosity and an optional filler. Tools according to embodiments of the invention exhibit long tool life, produce an acceptable quality of cut and can have self-dressing properties. The bond matrix can be used, for example, in abrasives tools configured for the electronics industry, such as 1A8 wheels for slicing ball grid arrays (BGAs) and other such slicing operations.

12 Claims, 6 Drawing Sheets

(56) References Cited

U.S. PATENT DOCUMENTS

| | | | | |
|---|---|---|---|---|
| 4,010,583 | A | 3/1977 | Highberg | |
| 4,173,685 | A | 11/1979 | Weatherly | |
| 4,180,048 | A | 12/1979 | Regan | |
| 4,738,689 | A | 4/1988 | Gigl et al. | |
| 4,977,710 | A | 12/1990 | Une | |
| 5,203,886 | A | 4/1993 | Sheldon et al. | |
| 5,213,589 | A | 5/1993 | Ronning et al. | |
| 5,221,294 | A | 6/1993 | Carman et al. | |
| 5,429,648 | A | 7/1995 | Wu | |
| 5,500,450 | A | 3/1996 | Simandl et al. | |
| 5,607,346 | A | 3/1997 | Wilson et al. | |
| 5,718,736 | A | 2/1998 | Onishi et al. | |
| 5,738,696 | A | 4/1998 | Wu | |
| 5,738,697 | A | 4/1998 | Wu et al. | |
| 5,832,360 | A | 11/1998 | Andrews et al. | |
| 5,940,507 | A | 8/1999 | Cane et al. | |
| 5,951,378 | A | 9/1999 | Miller et al. | |
| 6,019,667 | A | 2/2000 | Bush et al. | |
| 6,019,668 | A * | 2/2000 | Ramanath et al. | 451/41 |
| 6,056,795 | A | 5/2000 | Ramanath et al. | |
| 6,063,148 | A | 5/2000 | Fischbacher | |
| 6,086,648 | A | 7/2000 | Rossetti, Jr. et al. | |
| 6,093,092 | A * | 7/2000 | Ramanath et al. | 451/541 |
| 6,101,507 | A | 8/2000 | Cane et al. | |
| 6,102,789 | A * | 8/2000 | Ramanath et al. | 451/541 |
| 6,157,931 | A | 12/2000 | Cane et al. | |
| 6,193,593 | B1 | 2/2001 | Miller et al. | |
| 6,200,208 | B1 * | 3/2001 | Andrews et al. | 451/548 |
| 6,224,473 | B1 | 5/2001 | Miller et al. | |
| 6,254,660 | B1 | 7/2001 | Bernard et al. | |
| 6,319,108 | B1 | 11/2001 | Adefris et al. | |
| 6,354,929 | B1 | 3/2002 | Adefris et al. | |
| 6,372,012 | B1 | 4/2002 | Majagi et al. | |
| 6,416,560 | B1 * | 7/2002 | Palmgren | 51/309 |
| 6,478,831 | B2 * | 11/2002 | Tselesin | 51/293 |
| 6,536,352 | B1 * | 3/2003 | Nadkarni et al. | 102/506 |
| 6,593,391 | B2 * | 7/2003 | Teutsch et al. | 522/81 |
| 6,679,758 | B2 | 1/2004 | Bright et al. | |
| 6,685,755 | B2 | 2/2004 | Ramanath et al. | |
| 6,713,873 | B1 | 3/2004 | O'Loughlin et al. | |
| 6,755,729 | B2 | 6/2004 | Ramanath et al. | |
| 6,770,107 | B2 * | 8/2004 | Teutsch et al. | 51/298 |
| 7,077,723 | B2 | 7/2006 | Bright et al. | |
| 7,275,980 | B2 | 10/2007 | Bonner et al. | |
| 8,197,303 | B2 | 6/2012 | Tanikella et al. | |
| 2001/0025457 | A1 * | 10/2001 | Tselesin | 51/293 |
| 2002/0069592 | A1 * | 6/2002 | Sherman et al. | 51/309 |
| 2003/0018116 | A1 * | 1/2003 | Teutsch et al. | 524/430 |
| 2003/0153641 | A1 * | 8/2003 | Guo et al. | 522/71 |
| 2004/0033772 | A1 | 2/2004 | Goers | |
| 2005/0108948 | A1 | 5/2005 | Sung | |
| 2005/0260939 | A1 | 11/2005 | Andrews et al. | |
| 2006/0059785 | A1 | 3/2006 | Sung | |
| 2006/0213128 | A1 | 9/2006 | Sung | |
| 2007/0164490 | A1 * | 7/2007 | Cooper et al. | 264/605 |
| 2008/0168718 | A1 * | 7/2008 | Egan et al. | 51/307 |
| 2009/0084042 | A1 | 4/2009 | Ramanath et al. | |

FOREIGN PATENT DOCUMENTS

| | | | |
|---|---|---|---|
| JP | 91-161273 | | 7/1991 |
| JP | 91-281174 | | 12/1991 |
| JP | 91-03965 | | 4/1997 |
| JP | 10230464 | A | 9/1998 |
| JP | 2000-233374 | | 8/2000 |
| JP | 2001246566 | | 9/2001 |
| JP | 2002-001668 | | 8/2002 |
| JP | 2004-148469 | | 5/2004 |
| JP | 2004148469 | A | 5/2004 |
| JP | 2004291218 | A | 10/2004 |
| JP | 2005-136227 | | 5/2005 |
| JP | 2005-525242 | | 8/2005 |
| JP | 2005-254352 | | 9/2005 |
| JP | 2006-346857 | | 12/2006 |
| UA | 9 549 | U | 10/2005 |
| WO | 9948646 | A1 | 9/1999 |

OTHER PUBLICATIONS

International Preliminary Report on Patentability dated Apr. 7, 2010, from PCT/US2008/078071, 7 pages.

International Search Report from PCT/US2008/078071 mailed Mar. 3, 2009, 1 page.

* cited by examiner

ABRASIVE SLICING TOOL FOR ELECTRONICS INDUSTRY

RELATED APPLICATIONS

This application claims the benefit under 35 USC 119(e) of U.S. Provisional Application No. 61/077,604, filed on Jul. 2, 2008, which is incorporated herein by reference in its entirety.

FIELD OF THE INVENTION

The invention relates to abrasives technology, and more particularly, to abrasive tools and techniques for slicing materials used in the electronic industry, such as chip scale packaging including ball grid arrays and for slicing hard ceramic materials such as alumina, glass, ferrites, silicon, silicon carbide, and quartz.

BACKGROUND OF THE INVENTION

Copper-tin based metal bonds containing abrasives are generally known in the electronics' slicing and dicing industry. As is further known, alloying elements such as nickel, iron, titanium, and molybdenum can be added to the bond mix, to improve the wear resistance of such copper-tin systems for longer wheel life. In addition to improving the wheel life, these alloying elements may also improve the hardness and stiffness of the abrasive structure.

As an alternative to copper-tin bond systems, nickel-based abrasive structures have been used for improved durability and stiffness. For instance, U.S. Pat. No. 3,886,925 discloses a cutting wheel with an abrasive layer formed of high purity nickel electrolytically deposited from nickel solutions having finely divided abrasive suspended in them.

U.S. Pat. Nos. 6,056,795 and 6,200,208 describe abrasive wheels wherein a sintered metal bond includes a metal component such as molybedenum, rhenium, and tungsten (the '795 patent), or an active metal such as titanium, zirconium, hafnium, chromium, and tantalum (the '208 patent), which forms a chemical bond with the abrasive grains on sintering to improve the elastic modulus value of the abrasive wheel. The diamond retention is enhanced due to active metal alloying, leading to improvements in wheel life.

Other characteristics which are desirable in the electronics slicing industry include the ability of the cutting wheel to be self-dressing and operate at lower power. Generally, the self-dressing ability of an abrasive structure can be achieved by matching the wear rate of abrasive to that of the bond. This could be done sometimes through addition of elements such as silver, or by incorporation of soft fillers such as graphite and hexagonal boron-nitride. Another technique is to embrittle the microstructure by adding fillers such as silicon carbide and aluminum oxide, and/or by inducing porosity in the bond. Although such modifications may improve the self-dressing ability of the wheel, other properties of the wheel could be compromised. In this sense, there are a number of non-trivial competing factors that must be considered in the design of abrasive tools.

There is a need, therefore, for metal-based bond systems for abrasive tools that address such factors.

SUMMARY OF THE INVENTION

The invention generally relates to metal bonded abrasive tools such as slicing wheels and methods for producing them. Aspects of the invention relate to a bond that results in tools and articles that are hard, durable and self dressing.

In one embodiment, the present invention is directed to a metal bonded abrasive tool that includes abrasive grains, a metal bond composition, the composition including nickel, tin and a pre-alloyed bronze, the bronze being present in a phase that is essentially continuous in structure. The tool has less than about 20 volume total % porosity. Optionally, the tool can include a filler.

In another embodiment, the present invention is directed to a method for producing a metal bonded abrasive tool, the method including combining abrasive grains and a metal bond composition including nickel, tin and a pre-alloyed bronze, forming the combined abrasive grains and metal bond composition into a shaped body, and sintering the shaped body to produce the metal bonded abrasive tool, wherein the metal bonded abrasive tool has less than about 20% total porosity. A filler can optionally be added, e.g., prior to forming the shaped body.

In a further embodiment, the invention is directed to a metal bonded abrasive article, the article including a bond matrix that has less than about 20 volume % porosity based on the total volume of the tool. A metal bond system or composition present in the bond matrix comprises, consists essentially of or consists of three components: (i) a metal or alloy having a melting point within the range of from about 1100 degrees centigrade (° C.) to about 1600° C.; (ii) a component having a melting point of less than about 700° C., said component being capable of forming a transient liquid phase that is entirely or partially soluble in the metal or alloy of (i); and (iii) a pre-alloyed component having a melting point of less than about 800° C. and forming a phase that has an essentially continuous microstructure. The bond matrix can further include a filler. In preferred implementations, the bond matrix includes all the porosity present in the abrasive article.

In yet another embodiment, the invention is directed to a method for producing an abrasive article, such as, for example, a slicing wheel. The method includes forming a shaped body that includes abrasive grains, and the metal bond composition described above and densifying, e.g., via sintering, the shaped body to produce the abrasive article. Preferably, the abrasive article has a porosity of less than about 20 volume percent. In some embodiment, the abrasive grains, the metal bond composition or the combined abrasive grains and bond composition is/are further combined with a filler.

The invention is particularly well suited for grinding applications in the electronics industry, in particular in slicing ball grid arrays or to process other hard and brittle ceramics, such as, for instance, alumina, and has many advantages. Tools fabricated according to embodiments of the invention include a hard yet brittle bond, have long tool life and self dressing properties. They enable grinding at an acceptable power and result in acceptable quality of cut with regard to chipping and taper from top to bottom. The tool can be manufactured cost-effectively, using widely available materials and well known techniques. It can employ a range of abrasive grain sizes and types to produce workpieces of various quality levels. Tools in which at least a fraction of the abrasive e.g., diamond, grains have a metal coating exhibit enhanced grit retention and durability.

The features and advantages described herein are not all-inclusive and, in particular, many additional features and advantages will be apparent to one of ordinary skill in the art in view of the drawings, specification, and claims. Moreover, it should be noted that the language used in the specification has been principally selected for readability and instructional purposes, and not to limit the scope of the inventive subject matter.

DETAILED DESCRIPTION OF THE PREFERRED EMBODIMENTS

Figure 1:
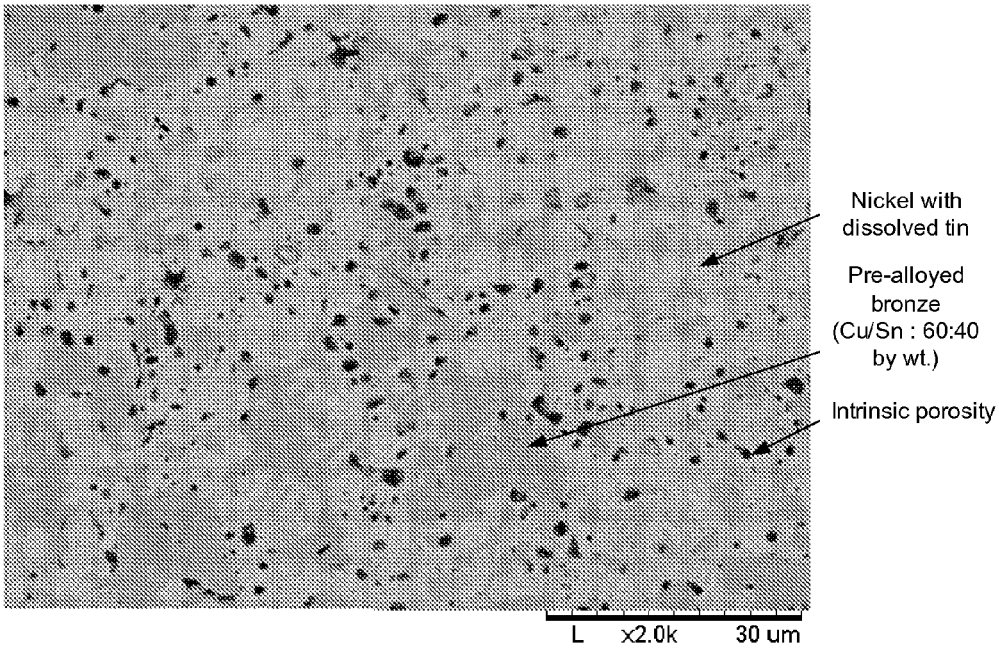
FIG. 1 illustrates a low magnification SEM image showing a Ni—Sn-Bronze bond system configured in accordance with an embodiment of the present invention.

Metal bonded abrasive articles generally are characterized by a three-dimensional structure in which abrasive grains or grits are held in a bond matrix. As previously noted, there are a number of non-trivial competing factors that must be considered in the design of abrasive tools. One example situation that demonstrates the relationship between wheel life, wear resistance, hardness, and wheel stiffness can be found in the case of an abrasive wheel exhibiting enhanced stiffness and extended wheel life due to improved grit retention and as the result of active metal alloying (e.g., such as described in U.S. Pat. No. 6,200,208). The addition of such an active metal improves the bond strength between the diamond and bond, thereby allowing the diamonds to be retained in the bond for a longer duration.

While such extended grain retention can be of benefit when using a friable grain, it may lead to an increase in grinding forces when using a blocky grain. This is because a blocky grain does not micro-fracture during grinding, thereby leading to a potentially unacceptable increase in grinding power caused by the drag of dull grains on the workpiece. Therefore, a hard but brittle bond is desirable, that would not only be durable and enable longer wheel life, but would also exhibit self-dressing behavior (timely release of worn-out grains) and enable grinding at a relatively low or otherwise acceptable power.

Disclosed herein is a bond matrix for abrasive tools that enables long tool life and the appropriate degree of wear resistance. In addition, the bond matrix imparts self-dressing abilities. The bond matrix can be used, for example, in abrasives tools configured for the electronics industry, such as 1A8 wheels for slicing ball grid arrays (BGAs) and in other tools such as abrasive wheels, honing tools, an other metal bonded abrasive articles.

The bond matrix includes a metal bond composition, also referred to herein as "system", porosity and, optionally, a filler.

Present in the metal bond composition or system are the following three components: (i) a metal or alloy having a melting point within the range of from about 1100 degrees centigrade (° C.) to about 1600° C.; (ii) a component having a melting point of less than about 700° C., said component being capable of forming a transient liquid phase that is entirely or partially soluble in the metal or alloy of (i); and (iii) a pre-alloyed component having a melting point of less than about 800° C., said pre-alloyed component forming a phase that is essentially continuous microstructure.

Examples of the first component, i.e., the metal or alloy having a melting point within the range of from about 1100 degrees centigrade (° C.) to about 1600° C., include nickel, cobalt, iron, manganese, silicon, alloys including these with other metals and other metals or alloys thereof. In specific examples, the first component has a melting point that is within the range of from about 1100 to about 1600, preferably within the range of from about 1100 to about 1480.

Examples of the second component, i.e., the component having a melting point of less than about 700° C. and capable of forming a transient liquid phase that is essentially entirely soluble in the metal or alloy of the first component, includes metals such as, for instance, tin, zinc, aluminum, indium, bismuth, antimony, combinations thereof, and so forth. In specific examples, the second component has a melting point that is less than about 700, preferably less than about 500.

The third component is pre-alloyed, has a melting point of less than about 800° C. and is present in the article as a phase that is continuous in structure. Suitable examples include but are not limited to copper-tin, copper-zinc, copper-tin-phosphorous, copper-tin-zinc and other combinations. In specific examples, the third component has a melting point that is less than about 800, preferably less than about 700.

As used herein, the term "continuous" refers to a three-dimensional network. A continuous phase may or may not be fully dense. It may include porosity and/or filler. In a three component matrix such as described above, if after removal, e.g., by selectively leaching the first and second component the structural skeleton that is left holds intact or together, then the third component phase is continuous. In the article described herein, more than one component can be present in a phase that is essentially continuous.

The metal bond composition or system can comprise, consists essentially of or consists of components (i), (ii) and (iii).

Based on the total weight of the three components, i.e., the total weight of the metal bond composition, component (i) can be present in an amount within the range of from about 20 to about 94.9 weight %; component (ii) can be present in an amount within the range of from about 5 to about 60 weight %; and component (iii) can be present in an amount within the range of from about 0.1 to about 50 weight %.

The bond matrix can further include a filler. Generally fillers do not alloy with the other components in the metal bond systems and their physical and chemical properties or states remain unchanged during the manufacturing process. Examples of suitable fillers include, for instance, carbides, oxides, sulfides, nitrides, borides, graphite, combinations thereof and so forth. In many cases, fillers are compounds that melt above 1200° C.

Soft fillers as well as hard fillers can be employed. Soft fillers such as, for instance, graphite, hexagonal boron nitride or others known in the art can be added, for example, to improve self dressing properties and reduce power drawn during grinding. Hard fillers, such as, for instance, tungsten carbide, silicon carbide, alumina, and so forth can be added, for example, to improve wear resistance and/or wheel life.

The bond matrix can be employed in conjunction with abrasive grains, e.g., superabrasives such as natural or synthetic diamond, cubic boron nitride (CBN) or other abrasive materials known in the art, e.g., alumina, silicon carbide, boron carbide or combinations of abrasive grains, to form an abrasive tool, for example, an abrasive wheel, e.g., a slicing wheel or other tools, such as wafer thinning wheels, honing sticks, cylindrical grinding wheels and others. In one example, at least some of the abrasive grains have a coating that includes a metal or its alloy. Suitable materials that can be utilized to coat abrasive grains, for instance diamond grains, include copper, nickel, silver, titanium, tungsten, chromium, silicon, combinations, or alloys thereof. Grains that include a metal coating can be obtained commercially, for example, under designations such as RJK1Cu, RVG-D and MBM-Ti, available from Diamond Innovations, Worthington, Ohio. Other types of metal-coated grains can be utilized. Agglomerated abrasive grains, such as described, for instance, in U.S. Pat. No. 7,275,980, issued on Oct. 2, 2007 to Bonner et al., the teachings of which are incorporated herein by reference in their entirety, also can be employed. Agglomerated grains can contain essentially no porosity or can in turn be porous.

Any suitable abrasive grain particle size can be selected, depending on the application, tool properties, fabrication processes and other considerations. For instance, the particle size of abrasive grains used for fabricating slicing wheels can be within the range of from about 2 microns (μm) to about 120 μm.

In specific embodiments, the article, e.g, tool, has relatively low porosity, e.g., about 20% by volume or less total porosity. Metal bonded abrasive articles according to the invention can have less than 10 volume % total porosity, less than 2 volume % total porosity or can be fully or essentially fully densified. In many implementations, the bond matrix includes all porosity present in the abrasive article.

Porosity can be imparted to an abrasive tool during manufacture (intrinsic porosity), by choosing specific grain and/or bond materials, fabrication, e.g., pressing conditions, carrying out a less than full densification and so forth; and/or by using pore-inducing materials, such as glass or plastic hollow spheres, shells, e.g., walnut shells, organic compounds that burn off during heating steps employed to form the tool, dispersoid materials that can be leached out, and other pore inducers, as known in the art. If no pore inducers are employed, the total porosity of the tool and its intrinsic porosity are the same.

In some implementations of the invention, the intrinsic porosity present in the tool is unevenly distributed between at least two of the multiple phases. As used herein, the phrase "unevenly distributed" refers to the presence of intrinsic porosity in one or more of the phases, while at least one other phase includes very minimal or no intrinsic porosity. A tool according to embodiments of the invention also can have an even or essentially even distribution of porosity among two or more phases. In specific examples, porosity is absent or essentially absent in the pre-alloyed phase. In other examples, the pre-alloyed phase includes porosity.

Articles according to the invention can include abrasive grains in an amount within the range of from about 5 to about 40 volume %, for example within the range of from about 5 to about 25 volume %; a metal bond (including the three components described above) within the range of from about 26 to about 95 volume %, for example, from about 50 to about 80 volume %; porosity within the range of from about 0 to about 20 volume %, for example, within the range of from about 0 to about 10 volume %; and fillers in an amount within the range of from about 0 to about 15 volume %, for example from about 0 to about 10 volume %.

Abrasive articles of the invention preferably have a bond matrix hardness within the range of about Vickers 60 to about Vickers 400 kg/mm$^2$, the load used being 100 grams (g).

One example of the present invention employs a metal bond composition or system that imparts to a tool, e.g., wheel, properties such as durability, wear resistance, stiffness, optimized fracture toughness and brittleness resulting in improved wheel life and the ability to grind at relatively low grinding power or force as further described below.

In preferred aspects of the invention, the metal bond system consists of, consists essentially of, or comprises: (i) nickel, (ii) tin and (iii) bronze. The term "bronze" generally refers to an alloy of tin and copper or an alloy including tin and copper. For example, a bronze can include tin, copper and phosphorous, with phosphorous being present in the bronze in an amount of less than about 12 weight %. The component (ii) tin refers to metallic or elemental tin and is distinct from the tin present in the pre-alloyed bronze.

Any or all of the three components can be provided in powder form. Typical median particle sizes can be, for instance, within the range of from about 0.5 μm to about_50 μm, e.g., from about 1 μm to about 20 μm for nickel; from about 0.5 μm to about 50 μm, e.g., from about 1 μm to about 20 μm for tin; and from about 1 μm to about 50 μm, e.g., from about 10 μm to about 50 μm for bronze.

The nickel-tin-bronze system can be used, for example, in conjunction with diamond abrasives or with other abrasive or superabrasive materials, with coated abrasives or with abrasive agglomerates, as those described above. In one example, the tool is made using diamond particle having a particle size within the range of from about 2 microns to about 120 microns. Other abrasive grain sizes, e.g., within the range of from about 2 μm to about 100 μm, or from about 20 μm to about 60 μm also can be employed.

In one implementation, the diamond and nickel-tin-bronze bond system tool is configured as a 1A8 slicing wheel. The bronze is pre-alloyed and has a copper-tin ratio from about 75:25 to about 40:60 by weight percent.

When observed by techniques such as scanning electron microscopy (SEM), transmission electron microscopy (TEM), optical microscopy, energy dispersive spectroscopy (EDS), or others, as known in the art, the tool has two or more phases, also referred to herein as "multiple phases". The phases can be distinguished from one another based on their microstructure. For instance, a tool manufactured using nickel, tin and bronze (pre-alloyed copper and tin) typically will have phases of distinct composition and/or distinct porosity.

A nickel-tin-bronze system can include from about 20 to about 94.9 weight percent nickel, e.g., from about 10 to about 70 weight percent nickel; from about 0.01 to about 60 weight percent tin, e.g., from about 5 to about 40 weight percent tin; and from about 0.01 to 50 weight percent bronze, e.g., from about 0.01 to about 40 weight percent bronze, wherein the bronze has a copper-tin ratio from about 75:25 to 40:60 by weight percent. An example tool is substantially densified, e.g., by sintering, and is configured to have less than 20 volume % total intrinsic porosity (and no induced porosity). Another example tool has a total porosity that is lower than about 10, e.g., less than about 2 volume %. In yet another case, the tool is fully densified, containing essentially no porosity.

In some instances, intrinsic porosity is limited to the nickel and tin phases of the finished tool, while the bronze phases is a continuous phase, exhibiting minimal or no intrinsic porosity. Without wishing to be held to any specific interpretation, it is believed that porosity can be absent or at a reduced level in the bronze phase or the phase of another pre-alloyed component, since the bronze typically is formed by atomizing liquid copper and tin resulting in a dense bronze powder. Thus when the three component metal bond melts, e.g., during hot pressing, the bronze phase forms a cast structure and the porosity remains confined (or mostly confined) to non-bronze regions, e.g., the nickel and/or tin areas.

In other instances, the pre-alloyed phase contains porosity, e.g., intrinsic porosity.

Distinguishing between a nickel-tin-bronze system and a nickel-tin-copper elemental bond system, which does not employ a pre-alloyed tin and copper combination, i.e., bronze, may be made based on microstructure of the tool. For instance, an elementally-made wheel may contain (i) a nickel with dissolved tin phase and (ii) a copper with dissolved tin phase, with porosity appearing in each of these phases. In contrast, intrinsic porosity appears only in the nickel and tin phases of a wheel made in accordance with one embodiment of the present invention, while the bronze phase exhibits essentially no porosity.

Unexpectedly, a tool made according to embodiments of the invention performs differently from a tool fabricated without using a pre-alloyed bronze and having an elemental composition of nickel-tin-copper bond with the same component percentages. In more detail, the tool configured with pre-alloyed bronze in accordance with embodiments of the present invention exhibits lower wheel wear rate and grinding power at comparable or better cut rates, and, furthermore, produces parts of comparable or better quality.

Without wishing to be held to any particular interpretation of the invention, it is believed that properties such as hardness and durability relate to a metal phase present in the bond and that brittleness and self dressing relate to the presence of a transient liquid phase that goes into solution with the metal phase. The pre-alloyed phase helps in densifying the tool by enabling liquid phase sintering. In addition, the pre-alloyed phase is usually brittle in nature, thereby enhancing the self-dressing ability of the tool.

The wear resistance of this nickel-tin-bronze bond system can be further optimized in order to improve wheel life and/or wear resistance by adding filler materials such as tungsten carbide, silicon carbide, alumina and other hard fillers. Fillers also may be added to improve self dressing properties and reduce power drawn during grinding. Examples include graphite, hexagonal boron nitride or other soft fillers.

In one example, the bond system includes nickel (e.g., particle size of 3 to 5 microns or less), tin (e.g., particle size of 10 microns or less, bronze (e.g., particle size of 44 microns or less), tungsten carbide (e.g., particle size of 1 micron or less), and diamond, such as MBG 620 diamond (e.g., particle size of 325/400 mesh, approximately 25 to 50 microns). The resulting tool, and has a Rockwell C hardness in the range of 20 to 35 $kg/mm^2$, and fracture toughness in the range of 1 to 10 $MPa \cdot m^{1/2}$.

The invention also can be practiced with metal bonds formed by using other pre-alloyed metal combinations to form a tool characterized by two or more distinct phases, one of these phases being a pre-alloyed phase continuous in structure. As described herein, porosity may be unevenly distributed among at least two of the phases, e.g., with minimal or no porosity appearing in the continuous pre-alloyed phase.

To fabricate an abrasive article such as the article disclosed herein, abrasive grains can be combined with the metal bond composition and, optionally, other ingredients such as fillers, pore inducing materials and so forth. Mixing or blending can be carried out using techniques and equipment known in the art. Combined materials are shaped, e.g., using a suitable mold, and the article is densified, e.g., by sintering or other thermal processes.

Thermal processing a metal bond together with the abrasive grains includes, for example, sintering, hot-pressing or hot coining the mix to form an abrasive article. Other suitable forming processes will be apparent in light of this disclosure (e.g., directly thermal processing the mix of bond components and abrasive grains, tape-casting to form green tape abrasive article and then sintering of green tape article, or injection molding a green article and then sintering of the green article). Typical temperatures that can be employed, for example, to densify, e.g., by sintering, a shaped body that includes diamond grains and a nickel, tin and bronze metal system are within the range of from about 400 to about 1100° C. For a shaped body that includes diamond abrasive grains, a nickel-tin-bronze metal system and tungsten carbide filler, sintering can be conducted at a temperature within the range of from about 400 to about 1200° C. Hot pressing can be conducted at a pressure within the range of from about 6.9 newtons/$m^2$ or Pascals (Pa) (corresponding to 0.5 tsi or 1000 pounds per square inch or psi) to about 41.4 Pa (3 tsi; 6000 psi), e.g., from about 6.9 Pa (0.5 tsi; 1000 psi) to 34.5 Pa (2.5 tsi; 5000 psi). Cold pressing can be conducted at a pressure within the range of from about 275.7 Pa (20 tsi; 40000 psi) to about 689.3 Pa (50 tsi; 100000 psi), e.g., from about 275.7 Pa (20 tsi; 40000 psi) to about 482.5 Pa (35 tsi; 70000 psi).

Example abrasive wheels configured in accordance with various embodiments of the present invention were prepared in the form of Type 1A8 metal bonded wheels utilizing materials and processes as will now be described. Numerous other embodiments will be apparent in light of this disclosure, and the present invention is not intended to be limited to any particular one.

EXAMPLE 1

A powder metal alloy consisting of nickel, tin and bronze was manufactured via the hot-press technology. In more detail, 20.32 grams of nickel powder (obtained from AcuPowder International LLC, Union, N.J. as 123 Nickel) was blended with 7.11 grams of tin (also obtained from AcuPowder International LLC, Union, N.J. as 115 Tin) and 72.63 grams of pre-alloyed bronze powder (obtained from Connecticut Engineering Assoc. Corp., Sandy Hook, Conn. as CEAC Alloy 822 powder, 60/40 Cu/Sn by weight percent) in a Turbula® mixer (the resulting nickel, tin, and bronze composition had a weight percent ratio of 20.32/7.11/12.10). Then, 2.33 grams of diamond (obtained from Diamond Innovations, Worthington, Ohio as MBG 620 325/400 mesh) was added to the mix and Turbula® mixed again to provide a homogenous blend. The resulting mixture was then cold-pressed in a steel mold at 35 tsi, followed by hot-pressing in a graphite mold at 850° C. for 20 minutes at 1.6 tsi (3200 psi). Upon cooling, the resulting abrasive disk was finished to a wheel of dimensions of 58 mm outer diameter (OD), 40 mm inner diameter (ID), and 300 μm thickness. This finished abrasive wheel is subsequently referred to herein as the Example 1 wheel.

The Example 1 wheel was compared to two conventional copper-tin based wheels, including one manufactured by Saint-Gobain Abrasives, Inc., (specification MXL 2115 of dimensions 58 mm OD, 40 mm ID, and 300 μm thickness) and the other by Disco Abrasive Systems K.K. (specification MBT-483 SD280N50M42 of dimensions 56 mm OD, 40 mm ID, and 350 μm thickness). Each wheel was tested on the same work material, using the same grinding conditions. In particular, each of the wheels was tested for slicing performance on a Pluschip 8.8×8.8 100 fine ball-grid array (FBGA) work material. The work material was mounted on a blue tape held firmly by two concentric circular hoops. The grinding machine was a MicroAce Dicing Saw, and the test mode was slicing/dicing in climb mode. The slight difference in the wheel size for Example 1 wheel and the MBT-483 wheel is negligible, in that wheel wear and grinding ratio in this particular application are independent of the wheel dimensions.

The conditions for the truing and dressing operations for each wheel are shown in Table 1. As is known, truing and dressing operations refer to wheel preparation before its use (or in between uses), and in this particular case, before its use under the grinding test conditions specified herein. The conditions for the truing and dressing operations include pad type and size, spindle speed, depth of cut, number of cuts, and feed rate. The truing and dressing pads were mounted on a blue tape held firmly by two concentric circular hoops.

TABLE 1

Truing and Dressing Operations

| Condition | Truing Operation | Dressing Operation |
|---|---|---|
| Truing pad specification | NMVC320-J5VCA | NMVC600-J8VCA |
| Truing pad size | 75 mm × 75 mm | 75 mm × 75 mm |
| Spindle speed | 3000 rpm | 30,000 rpm |
| Depth of cut | 0.075 mm | 1.078 mm |
| No. of cuts | 20 | 5 each at 3 feed rates |
| Feed rate/ table speed | 5 mm/sec | 30 mm/sec, followed by 60 mm/sec, followed by 100 mm/sec |

Particulars of the test grinding process, including coolant type and flow rate, spindle speed, feed rate, work material size, depth of cut, number of cuts, and length of run are specified in Table 2. Recall that the work material was a Pluschip 8.8×8.8 100 FBGA.

TABLE 2

Grinding Process Parameters

| | |
|---|---|
| Coolant type | DI water |
| Coolant rate | 1 liter/min |
| Spindle speed | 30,000 rpm |
| Feed rate | 140 mm/sec |
| Work material size | 100 mm × 100 mm |
| Depth of cut | 0.965 mm |
| No. of cuts | Variable for each wheel |
| Length of run | 56 meters (wheel wear), 0.5 meters (quality) |

Results for the grinding test for the Example 1 wheel as compared to the conventional wheels MXL 2115 and MBT-483 are shown in Table 3.

TABLE 3

Grinding Results

| | Example 1 wheel | | MXL 2115 | | MBT-483 | |
|---|---|---|---|---|---|---|
| Cumulative cut length (meters) | Cumulative radial wheel wear (μm) | Power at end of run (Watts) | Cumulative radial wheel wear (μm) | Power at end of run (Watts) | Cumulative radial wheel wear (μm) | Power at end of run (Watts) |
| 56.5 | 10 | 160 | 26 | 134 | 13 | 167 |
| 113 | 19 | 156 | 38 | 140 | 18 | 165 |
| 169.5 | 29 | 162 | 52 | 139 | 33 | 166 |
| 226 | 32 | 162 | 67 | 140 | 38 | 164 |
| 282.5 | 40 | 173 | 87 | 147 | 49 | 170 |
| 339 | 48 | 171 | | | | |
| 395.5 | 53 | 177 | | | | |
| 452 | 68 | 180 | | | | |
| 508.5 | 69 | 180 | | | | |
| 565 | 79 | 174 | | | | |

As can be seen, the Example 1 wheel exhibits significantly improved wheel wear than the MXL 2115 wheel at the expense of an increase in power of about 11% to 16%. With respect to the MBT-483 wheel, the Example 1 wheel generally exhibits a 10% to 30% improvement in wheel wear over the cut length, while the power consumption remains relatively comparable. The grinding results are summarized as average wheel wear and average power in Table 4.

TABLE 4

Comparison of grinding results

| | Example 1 wheel | MXL 2115 | MBT-483 |
|---|---|---|---|
| Average wheel wear (μm/m) | 0.1416 (after slicing through 282.5 m) 0.1398 (after slicing through 565 m) | 0.3080 (after slicing through 282.5 m) | 0.1735 (after slicing through 282.5 m) |
| Average power at end of run (Watts) | 162.6 (after slicing through 282.5 m) 169.5 (after slicing through 565 m) | 140 (after slicing through 282.5 m) | 166.4 (after slicing through 282.5 m) |

As can be seen, the Example 1 wheel exhibits an average wheel wear that is about 50% lower than the wheel wear of the MXL 2115 wheel, and about 20% lower than the wheel wear of the MBT-483 wheel. The average power used in grinding with the Example 1 wheel is about 15% higher with respect to the MXL 2115 wheel and slightly lower or otherwise comparable to the MBT-483 wheel.

EXAMPLE 2

Example 2 refers to an example slicing wheel configured in accordance with another embodiment of the present invention (subsequently referred to herein as the Example 2 wheel). In particular, the Example 2 wheel was made from a composition including nickel, tin, and bronze in the weight percent ratio of 56/14/30. Diamond content was the same as in the Example 1 wheel. In general, and relative to the Example 1 wheel, the Example 2 wheel has a higher nickel content and exhibited a higher wear resistance. Due to the higher nickel content, the wheel was processed at 950° C.

The Example 2 wheel was tested for comparison of grinding data, in a similar fashion as was done with the Example wheel 1. Tables 5 and 6 detail the grinding results.

TABLE 5

Grinding Results

| | Example 2 wheel | | MXL 2115 | | MBT-483 | |
|---|---|---|---|---|---|---|
| Cumulative cut length (meters) | Cumulative radial wheel wear (μm) | Power at end of run (Watts) | Cumulative radial wheel wear (μm) | Power at end of run (Watts) | Cumulative radial wheel wear (μm) | Power at end of run (Watts) |
| 56.5 | 6 | 156 | 26 | 134 | 13 | 167 |
| 113 | 6 | 149 | 38 | 140 | 18 | 165 |
| 169.5 | 19 | 153 | 52 | 139 | 33 | 166 |
| 226 | 20 | 148 | 67 | 140 | 38 | 164 |
| 282.5 | 23 | 153 | 87 | 147 | 49 | 170 |
| 339 | 30 | 157 | | | | |
| 395.5 | 36 | 152 | | | | |
| 452 | 45 | 158 | | | | |

As can be seen by the grinding results shown in Table 5, the Example 2 wheel exhibits significantly improved (about 3 to 5 times lower) wheel wear with respect to the MXL 2115 wheel at the expense of an increase in power of about 5% to 15%. With respect to the MBT-483 wheel, the Example 2 wheel exhibits about a 40% to 70% improvement in wheel wear over the cut length, and at a consistently lower power usage.

TABLE 6

Comparison of grinding results

| | Example 2 wheel | MXL 2115 | MBT-483 |
|---|---|---|---|
| Average wheel wear (μm/m) | 0.0814 (after slicing through 282.5 m) 0.0995 (after slicing through 452 m) | 0.3080 (after slicing through 282.5 m) | 0.1735 (after slicing through 282.5 m) |
| Average power at end of run (Watts) | 152 (after slicing through 282.5 m) 153 (after slicing through 452 m) | 140 (after slicing through 282.5 m) | 166.4 (after slicing through 282.5 m) |

These grinding results for the Example 2 wheel are summarized as average wheel wear and average power in Table 6. As can be seen, the Example 2 wheel has an average wheel wear that is about 50% lower than the MBT-483 average wheel wear, which translates into about a 100% improvement in wheel life. Likewise, the Example 2 wheel has an average wheel wear that is about 75% lower than the MXL 2115 average wheel wear.

EXAMPLE 3

Example 3 refers to an example grinding wheel comprising an elemental composition (subsequently referred to herein as the Example 3 wheel). In particular, the Example 3 wheel was made (without using a pre-alloyed bronze) from a composition including elemental nickel, tin, and copper in the weight percent ratio of 49/33/18. Recall that the pre-alloyed bronze used in the Example 1 wheel was a 60/40 by weight percent ratio of copper and tin, so both the Example 1 wheel composition and the Example 3 wheel composition have the same levels of nickel, tin and copper. Specifically, the amounts of various components used to produce the Example 3 wheel included 19.66 grams of nickel, 10.81 grams of tin, 7.22 grams of copper. Diamond content and forming methods were the same as with the Example 1 wheel.

The Example 3 wheel was compared to the Example 1 wheel (via grinding tests as previously described), with respect to bond durability and wheel life. Tables 7 and 8 detail the grinding results.

TABLE 7

Grinding Results

| | Example 1 wheel | | Example 3 wheel | |
|---|---|---|---|---|
| Cumulative cut length (meters) | Cumulative radial wheel wear (μm) | Power at end of run (Watts) | Cumulative radial wheel wear (μm) | Power at end of run (Watts) |
| 56.5 | 10 | 160 | 10 | 144 |
| 113 | 19 | 156 | 23 | 147 |
| 169.5 | 29 | 162 | 33 | 141 |
| 226 | 32 | 162 | 46 | 150 |
| 282.5 | 40 | 173 | 61 | 151 |
| 339 | 48 | 171 | | |
| 395.5 | 53 | 177 | | |
| 452 | 68 | 180 | | |

As can be seen by the grinding results shown in Table 7, the pre-alloyed bronze Example 1 wheel exhibits increasingly better wheel wear (as cut length increases) relative to the elementally-made Example 3 wheel, at the expense of an increase in power of about 5% to 15%.

TABLE 8

Comparison of grinding results

| | Example 1 wheel | Example 3 wheel |
|---|---|---|
| Average wheel wear | 0.1416 (after slicing through 282.5 m) | 0.2159 (after slicing through 282.5 m) |

TABLE 8-continued

| Comparison of grinding results | | |
|---|---|---|
| | Example 1 wheel | Example 3 wheel |
| (μm/m) | 0.1398 (after slicing through 565 m) | |
| Average power at end of run (Watts) | 163 (after slicing through 282.5 m)<br>169 (after slicing through 565 m) | 147 (after slicing through 282.5 m) |

These grinding results for the Example 3 wheel are summarized as average wheel wear and average power in Table 8. As can be seen, the pre-alloyed bronze Example 1 wheel has an average wheel wear that is about 35% lower than the elementally-made Example 3 wheel average wheel wear, at the expense of an increase in average power of about 10%.

EXAMPLE 4

Example 4 refers to an example grinding wheel configured in accordance with another embodiment of the present invention (subsequently referred to herein as the Example 4 wheel). In particular, the bond material for the Example 4 wheel comprises nickel-tin-bronze, and further contains 5 volume % of a hard tungsten carbide filler (obtained from Cerac Specialty Inorganics, Milwaukee, Wis. as tungsten carbide, WC, 99.5% pure, <1 micron average particle size). The weight percent ratios of Ni—Sn-Bronze-WC in the Example 4 wheel are 44.74/19.17/27.39/8.69, respectively. Diamond content and forming methods were the same as with the Example 1 wheel. Due to addition of fine tungsten carbide (WC) to the nickel-tin-bronze bond, the wear resistance and durability of the bond further improves, thereby further increasing wheel life. This improvement comes at a modest increase in grinding power (e.g., 10% or less), relative to a comparable nickel-tin-bronze wheel made without the tungsten carbide.

EXAMPLE 5

Example 5 refers to an example slicing wheel configured in accordance with another embodiment of the present invention (subsequently referred to herein as the Example 5 wheel). In particular, the Example 5 wheel was made from a composition including nickel, tin, and bronze in the weight percent ratio of 56/14/30. Diamond content, type and size were the same as with the Example 2 wheel. In general, and relative to the Example 2 wheel, the Example 5 wheel was processed at a temperature of 950° C.) and for longer duration (40 minutes). The Example 5 wheel was tested for comparison of grinding data, in a similar fashion as was done with the Example wheel 1. Tables 9 and 10 detail the grinding results.

TABLE 9

| Grinding Results | | | | | | |
|---|---|---|---|---|---|---|
| | Example 5 wheel | | MXL 2115 | | MBT-483 | |
| Cumulative cut length (meters) | Cumulative radial wheel wear (μm) | Power at end of run (Watts) | Cumulative radial wheel wear (μm) | Power at end of run (Watts) | Cumulative radial wheel wear (μm) | Power at end of run (Watts) |
| 56.5 | 0 | 206 | 26 | 134 | 13 | 167 |
| 113 | 6 | 183 | 38 | 140 | 18 | 165 |
| 169.5 | 13 | 180 | 52 | 139 | 33 | 166 |
| 226 | 20 | 189 | 67 | 140 | 38 | 164 |
| 282.5 | 31 | 196 | 87 | 147 | 49 | 170 |
| 339 | 38 | 189 | | | | |
| 395.5 | 51 | 188 | | | | |
| 452 | 60 | 205 | | | | |

As can be seen by the grinding results shown in Table 9, the Example 5 wheel exhibits significantly improved (about 3 to 5 times lower) wheel wear with respect to the MXL 2115 wheel at the expense of an increase in power of about 10% to 20%. With respect to the MBT-483 wheel, the Example 5 wheel exhibits about a 40% to 70% improvement in wheel wear over the cut length, and at a consistently lower power usage.

TABLE 10

| Comparison of grinding results | | | |
|---|---|---|---|
| | Example 5 wheel | MXL 2115 | MBT-483 |
| Average wheel wear (μm/m) | 0.1097 (after slicing through 282.5 m)<br>0.1327 (after slicing through 452 m) | 0.3080 (after slicing through 282.5 m) | 0.1735 (after slicing through 282.5 m) |
| Average power at end of run (Watts) | 191 (after slicing through 282.5 m)<br>192 (after slicing through 452 m) | 140 (after slicing through 282.5 m) | 166.4 (after slicing through 282.5 m) |

These grinding results for the Example 5 wheel are summarized as average wheel wear and average power in Table 10. As can be seen, the Example 5 wheel has an average wheel wear that is about 60% lower than the MBT-483 average wheel wear. Likewise, the Example 5 wheel has an average wheel wear that is about 180% lower than the MXL 2115 average wheel wear.

Wheel Stiffness

In addition to durability (bond wear resistance), high wheel stiffness is also desirable, particularly in slicing applications for straightness of cut (e.g., BGA slicing). In theory, nickel-based bond systems should possess higher wheel stiffness than traditional copper based systems, since nickel metal is stiffer than copper. However, due to under-sintering and interfacial sliding between the diamond and the bond, the stiffness is not completely transferred to the matrix.

Table 11 details the stiffness (Young's modulus) of the wheels, calculated by measuring the ultrasonic velocity of sound in each of the given bond systems.

TABLE 11

Summary of stiffness data on different wheels

| Wheel | Wheel Density (g/cc) | Longitudinal Velocity (mm/μsecond) | Poisson Ratio (Assumed value) | Young's Modulus (GPa) |
|---|---|---|---|---|
| Example 1 wheel | 8.06 | 5.65 | 0.33 | 174 |
| MXL 2115 | 7.30 | 5.04 | 0.33 | 125 |
| MBT-483 | 7.51 | 5.12 | 0.33 | 133 |

As can be seen, the Example 1 wheel exhibits superior wheel stiffness in comparison to the MXL 2115 and MBT-483 wheels. The stiffness of Example 2 and 4 wheels increases relative to that of the Example 1 wheel. Embodiments of the present invention generally exhibit a Young's modulus of 145 GPa or higher, or more specifically, 155 GPa or higher, or even more specifically, 170 GPa or higher.

Bond Microstructure

Figure 2:
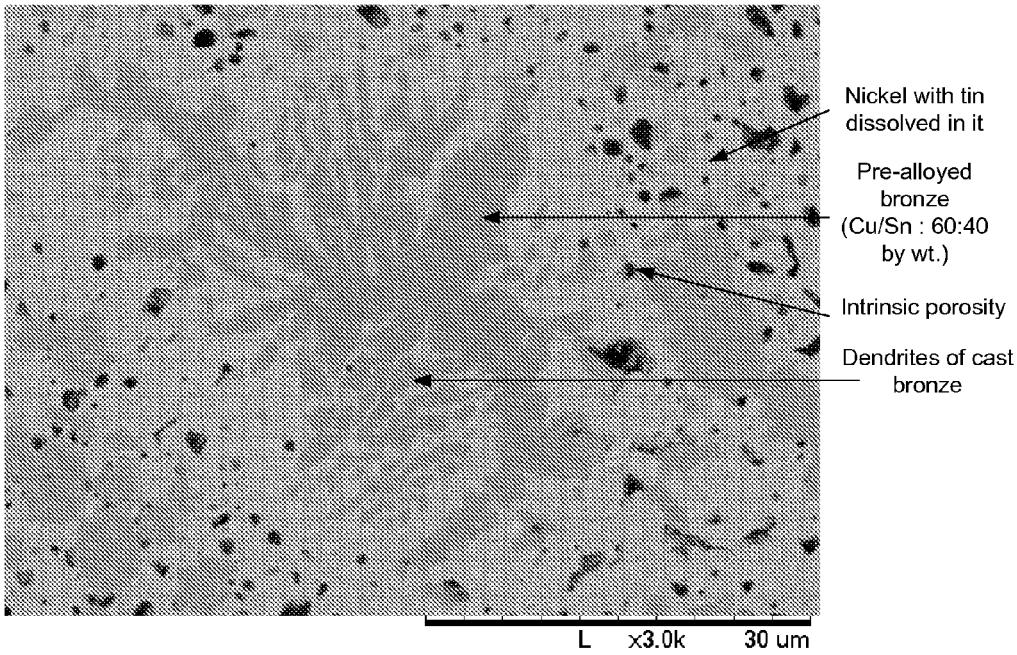
FIG. 2 illustrates a SEM image showing a cast bronze structure in the Ni—Sn-Bronze bond of FIG. 1.

The mechanical properties of an abrasive wheel bond depend largely on the microstructure and its behavior during grinding operations. FIGS. 1 and 2 each shows a SEM image of polished cross section of the Ni—Sn-Bronze (49/21/30) bond system, in accordance with an embodiment of the present invention. As can be seen, the microstructure includes two distinct metallic phases, one being a nickel with dissolved tin phase, and the other being a pre-alloyed bronze phase (e.g., Cu/Sn ration of 60:40 by wt %). There is also some intrinsic porosity (less than 20 volume %), when hot-pressed (e.g., at about 850° C.). In addition, FIG. 2 shows presence of a cast tin bronze structure that includes cored dendrites, which have a composition gradient of increasing tin as they grow outward from the pre-alloyed bronze phase. The last liquid to solidify is enriched with tin upon cooling, and forms alpha and delta phases. The pre-alloyed bronze particles do not have any porosity since they are made by atomizing liquid copper and tin leading to dense bronze powder. When the bond melts again during hot pressing, the porosity is confined (or mostly confined) to nickel and tin areas.

Figure 3:
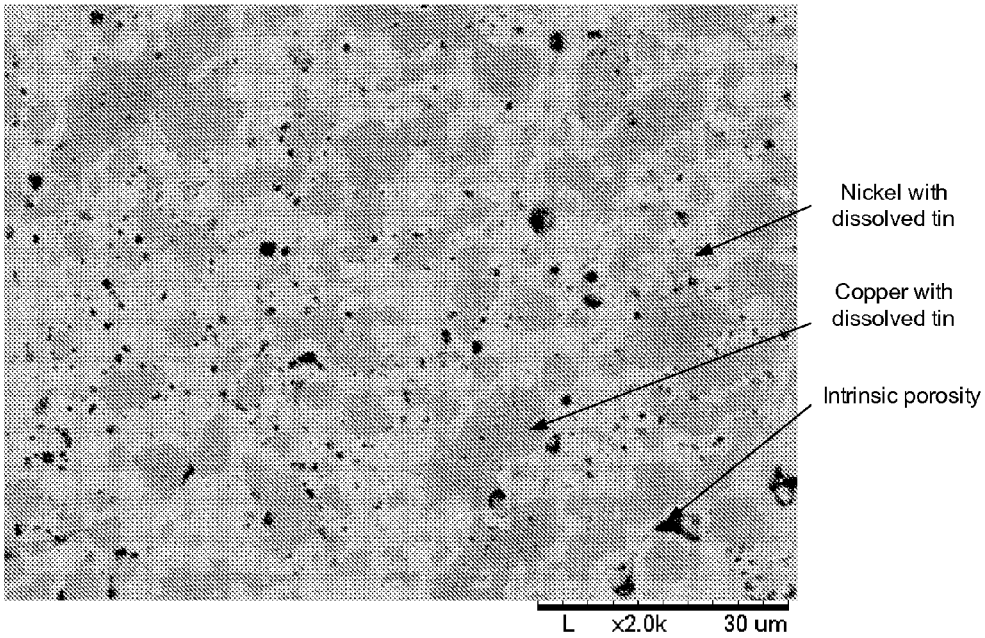
FIG. 3 illustrates a low magnification SEM image showing a conventional Ni—Sn—Cu bond system.
Figure 4:
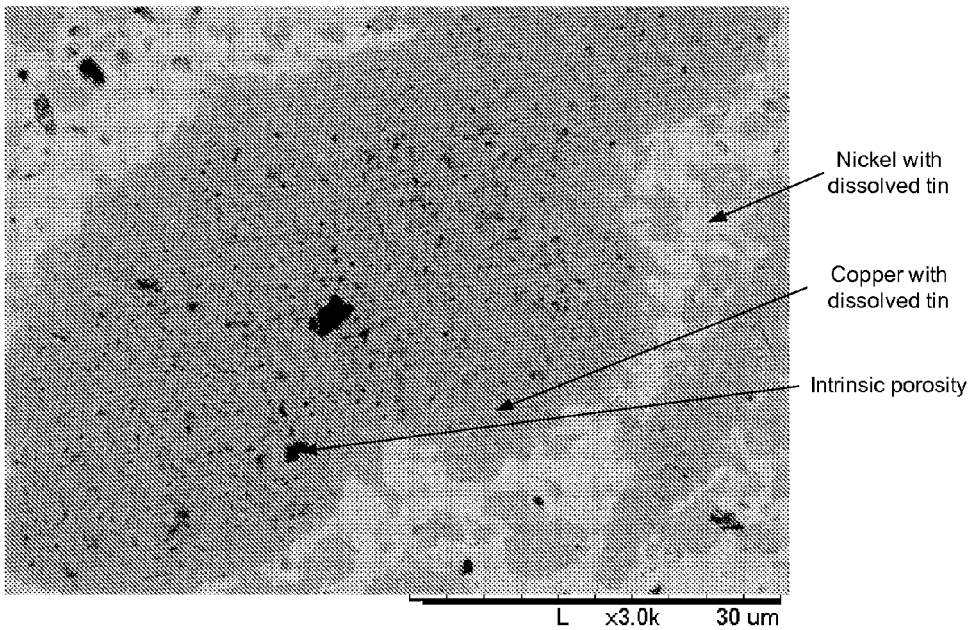
FIG. 4 illustrates a SEM image showing an under-sintered bronze structure in the Ni—Sn—Cu bond of FIG. 3.

On the other hand, FIGS. 3 and 4 show a SEM image of a bond system made from a composition including elemental nickel, tin and copper in the weight percent ratio of 49/33/18 (which has the same elemental composition with same levels of nickel, tin and copper as the system shown in FIG. 1). As can be seen, the microstructure includes a nickel with dissolved tin phase, and a copper with dissolved tin phase. When hot-pressed at the same temperature and pressure as the structure shown in FIGS. 1 and 2, a similar porosity level is obtained. However, the result has an under-sintered copper-tin structure with intrinsic porosity, as shown in FIG. 4. The porosity is present in all phases of the microstructure, including the copper-tin formations. This all-phase intrinsic porosity is a telltale sign that can be used to distinguish tools employing elemental nickel-tin-copper bond systems from tools that employ nickel-tin-bronze bond systems. In addition, this even distribution of intrinsic porosity among all phases may also contribute to increased wheel wear rate in slicing applications (undesirably so).

Figure 5:
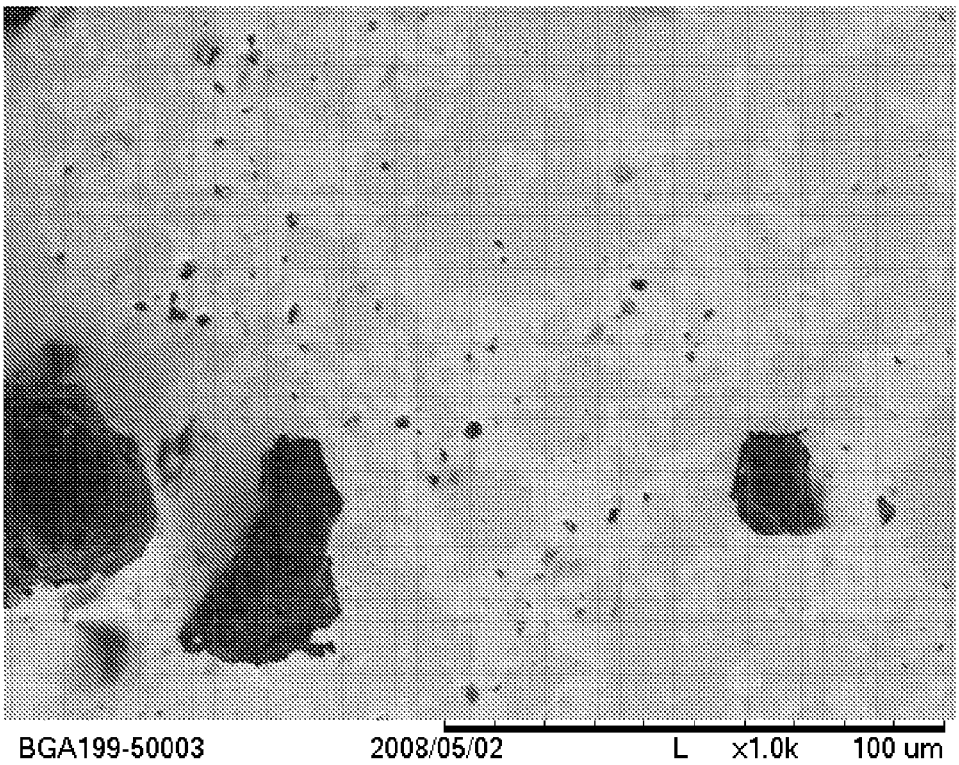
FIG. 5 and FIG. 6 are SEM images of a wheel according to an embodiment of the invention.
Figure 6:
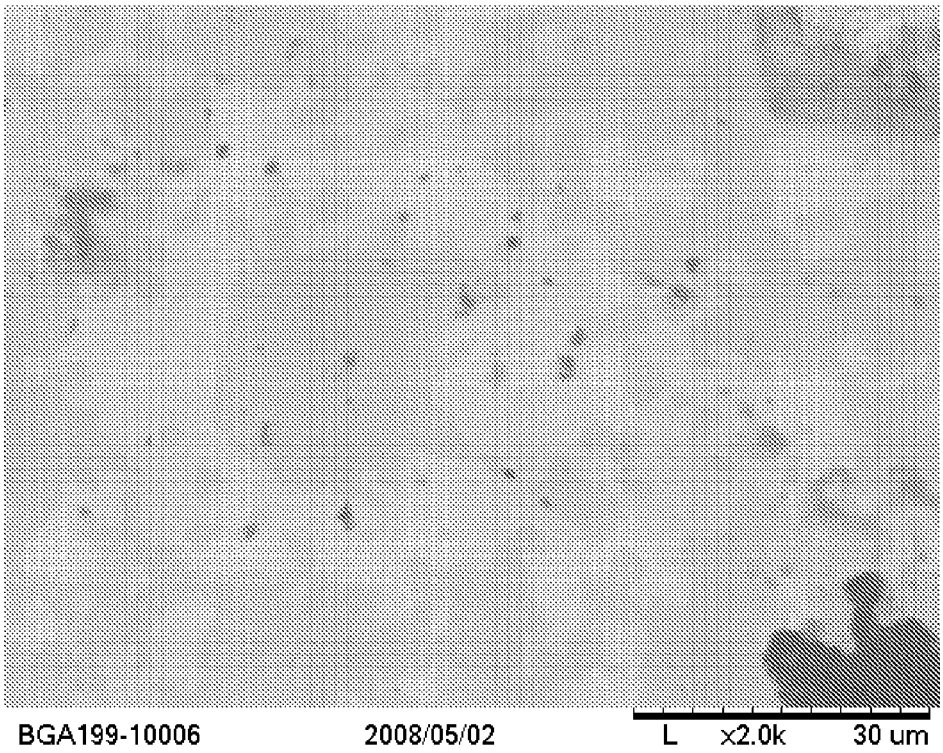

FIGS. 5 and 6 are SEM images of Example 5 wheel, showing porosity in both phases.

The foregoing description of the embodiments of the invention has been presented for the purposes of illustration and description. It is not intended to be exhaustive or to limit the invention to the precise form disclosed. Many modifications and variations are possible in light of this disclosure. It is intended that the scope of the invention be limited not by this detailed description, but rather by the claims appended hereto.

What is claimed is:

1. A metal bonded abrasive tool comprising:

a. abrasive grains;

b. a metal bond composition including from about 10 to about 70 weight percent nickel, from about 5 to about 40 weight percent tin and a continuous phase of from about 0.01 to about 40 weight percent pre-alloyed bronze; and c. less than about 20 volume % total porosity.

2. The metal bonded abrasive tool of claim 1, wherein the tool has less than about 10 volume % total porosity.

3. The metal bonded abrasive tool of claim 1, wherein at least a fraction of the abrasive grains have a coating that includes a metal or an alloy thereof.

4. The metal bonded abrasive tool of claim 1, wherein the metal bonded abrasive tool further comprises a filler.

5. The metal bonded abrasive tool of claim 1, wherein the metal bond composition has a hardness within the range of from about Vickers 60 kg/mm$^2$ to about Vickers 400 kg/mm$^2$ at a 100 g load.

6. The metal bonded abrasive tool of claim 1, wherein at least some of the abrasive grains have a coating that includes a metal or an alloy thereof.

7. The metal bonded abrasive tool of claim 1, wherein the metal bonded abrasive tool has a porosity that is less than about 10 volume %.

8. The metal bonded abrasive tool of claim 1, wherein the tool is self dressing.

9. The metal bonded abrasive tool of claim 1, wherein the abrasive grains are diamond abrasive grains.

10. The metal bonded abrasive tool of claim 9, wherein the diamond abrasive grains have a particle size within the range of from about 2 microns to about 120 microns.

11. The metal bonded abrasive tool of claim 4, wherein the filler is selected from the group consisting of tungsten carbide, silicon carbide, alumina graphite, hexagonal boron nitride and any combination thereof.

12. The metal bonded abrasive tool of claim 1, wherein the total porosity is intrinsic porosity.

* * * * *